US009845444B2

(12) United States Patent
Lee et al.

(10) Patent No.: US 9,845,444 B2
(45) Date of Patent: Dec. 19, 2017

(54) CLEANING COMPOSITION AFTER CHEMICAL MECHANICAL POLISHING OF ORGANIC FILM AND CLEANING METHOD USING THE SAME

(71) Applicant: Samsung Electronics Co., Ltd., Suwon-si, Gyeonggi-do (KR)

(72) Inventors: Ahn-Ho Lee, Yongin-si (KR); Chung-Kyung Jung, Anyang-si (KR); Dong-Min Kang, Seoul (KR); Dong-Hun Kang, Suwon-si (KR); Go-Un Kim, Suwon-si (KR); Dong-Jin Kim, Suwon-si (KR); Yong-Sik Yoo, Suwon-si (KR); Young-Chul Jung, Suwon-si (KR); Yu-Ri Jung, Suwon-si (KR); Jung-Min Choi, Suwon-si (KR); Sang-Kyun Kim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 55 days.

(21) Appl. No.: 14/942,206

(22) Filed: Nov. 16, 2015

(65) Prior Publication Data

US 2016/0137953 A1 May 19, 2016

(30) Foreign Application Priority Data

Nov. 18, 2014 (KR) ..... 10-2014-0161215

(51) Int. Cl.

| | |
|---|---|
| ***C11D 7/50*** | (2006.01) |
| ***C11D 1/00*** | (2006.01) |
| ***C11D 3/20*** | (2006.01) |
| ***C11D 3/30*** | (2006.01) |
| ***C11D 11/00*** | (2006.01) |

(Continued)

(52) U.S. Cl.

CPC ..... *C11D 1/008* (2013.01); *C11D 1/662* (2013.01); *C11D 1/667* (2013.01); *C11D 1/72* (2013.01); *C11D 3/2079* (2013.01); *C11D 3/28* (2013.01); *C11D 3/30* (2013.01); *C11D 3/43* (2013.01); *C11D 11/0047* (2013.01)

(58) Field of Classification Search

CPC ..... C11D 11/0047

See application file for complete search history.

(56) References Cited

U.S. PATENT DOCUMENTS

| | | | |
|---|---|---|---|
| 6,143,705 | A | 11/2000 | Kakizawa et al. |
| 6,410,494 | B2 | 6/2002 | Kakizawa et al. |

(Continued)

FOREIGN PATENT DOCUMENTS

| | | | |
|---|---|---|---|
| JP | 2003-109930 | A | 4/2003 |
| JP | 4232002 | B2 | 3/2009 |

(Continued)

OTHER PUBLICATIONS

Korean Office Action dated Jan. 31, 2017 issued in corresponding Korean Patent Application No. 10-2014-0161215 (English translation has not provided).

*Primary Examiner* — Gregory Webb

(74) *Attorney, Agent, or Firm* — Harness, Dickey & Pierce, P.L.C.

(57) ABSTRACT

A cleaning composition includes an organic solvent, an organic acid, a chelating agent, a surfactant containing at least one hydroxyl group (OH) at the end, and an ultra pure water, wherein a pH value of the cleaning composition is equal to or higher than 12.

14 Claims, 2 Drawing Sheets

(51) Int. Cl.

| | |
|---|---|
| ***C11D 1/66*** | (2006.01) |
| ***C11D 1/72*** | (2006.01) |
| ***C11D 3/28*** | (2006.01) |
| ***C11D 3/43*** | (2006.01) |

(56) References Cited

U.S. PATENT DOCUMENTS

| | | | | |
|---|---|---|---|---|
| 6,514,921 | B1 | 2/2003 | Kakizawa et al. | |
| 2004/0038840 | A1* | 2/2004 | Lee | C11D 3/0073 510/202 |
| 2009/0291873 | A1 | 11/2009 | Tamboli | |
| 2013/0157919 | A1 | 6/2013 | Mellies et al. | |
| 2015/0166942 | A1* | 6/2015 | Kang | B08B 1/002 438/479 |

FOREIGN PATENT DOCUMENTS

| | | | |
|---|---|---|---|
| JP | 2014-036136 | A | 2/2014 |
| KR | 10-0322392 | B1 | 3/2002 |
| KR | 2004-0009783 | A | 1/2004 |
| KR | 2007-0122265 | A | 12/2007 |

* cited by examiner

CLEANING COMPOSITION AFTER CHEMICAL MECHANICAL POLISHING OF ORGANIC FILM AND CLEANING METHOD USING THE SAME

CROSS-REFERENCE TO RELATED APPLICATIONS

This application is based on and claims priority from Korean Patent Application No. 10-2014-0161215, filed on Nov. 18, 2014, in the Korean Intellectual Property Office, the disclosure of which is incorporated herein in its entirety by reference.

BACKGROUND

1. Technical Field

Example embodiments of the present inventive concepts relates to a cleaning composition after polishing an organic film and a cleaning method using the same. More particularly, example embodiments of the present inventive concepts relates to a cleaning composition after chemical mechanical polishing (CMP) an organic film and a cleaning method using the same, which can efficiently remove pollutants that remain on the surface of the organic film.

2. Discussion of the Related Art

Recently, with the relatively high integration and relatively high performance of a semiconductor device, the line width of a wire pattern has been further micronized, and the structure thereof has become gradually multilayered. In order to improve precision of photolithography, flatness between layers in each process acts as an important factor. At present, a chemical mechanical polishing (CMP) process has been identified as such a planarization technology. The CMP process may be classified into an oxide CMP process, a metal CMP process, a poly-Si CMP process, and an organic CMP process in accordance with the material to be polished.

A representative semiconductor process to which a CMP process for polishing an organic film is applied may be a gap-fill process. The gap-fill process is a process to fill a via-hole with an organic film material. After the gap-fill process, the CMP process is performed for planarization through removal of the excessively formed organic film.

After the polishing of the organic film according to the CMP process, foreign substances, for example, the organic film dregs, or residual substances, for example, polished particles of the CMP slurry composition, may remain on the surface of the organic film. Because such foreign substances or residual substances may deteriorate productivity and reliability of final products, a cleaning process should be included to remove the pollutants.

In the case of an inorganic film, for example, silicon, cleaning may be performed by slightly etching the surface of the inorganic film to remove the pollutants on the surface of the inorganic film. However, in the case of a soft film material, which is desirable for an organic film, the cleaning method to etch the surface of the film material is unable to be performed due to the characteristics of the organic film.

The cleaning of an organic film is performed by, for example, spraying a cleaning composition and at the same time, rotating a brush that is made of polyvinyl alcohol to clean a wafer on which the organic film is formed. In this case, the pollutants generated in the polishing process may be re-adsorbed onto the brush to pollute the brush, and the pollutants adsorbed onto the brush are transferred again to the wafer to re-pollute the polished surface. Since this phenomenon is repeated, the cleaning efficiency is decreased and the lifespan of the brush is also shortened to deteriorate process capability.

In the case of cleaning using the brush, the pollutants tend to collect at edges and in the center of the wafer. Particularly, in the case of the organic film, a gap between the brush and the wafer may be narrowed to increase the cleaning efficiency. In this case, the brush and the wafer may frequently come in contact with each other, and thus if the brush is polluted, the tendency that the pollutants collect at the edges and in the center of the wafer becomes greater to cause the cleaning efficiency to be abruptly decreased.

Further, in the case of performing the cleaning using the brush, scratches may be generated on the surface of the organic film.

SUMMARY

Example embodiments of the present inventive concepts provide a cleaning method after chemical mechanical polishing (CMP) an organic film and a cleaning method using the same.

Example embodiments also provide a cleaning composition having an improved cleaning effect after polishing an organic film. Example embodiments further provide a cleaning composition which can minimize or reduce re-adsorption of pollutants that remain on the surface of an organic film onto a brush and the organic film after cleaning, and/or minimize or reduce generation of a scratch on the surface of an organic layer after cleaning.

According to example embodiments of the present inventive concepts, a cleaning composition includes an organic solvent, an organic acid, a chelating agent, a surfactant containing at least one hydroxyl group (OH) at the end, and an ultra pure water, wherein a pH value of the cleaning composition is equal to or higher than 12.

Additional advantages, subjects, and features of the inventive concepts will be set forth in part in the description which follows and in part will become apparent to those having ordinary skill in the art upon examination of the following or may be learned from practice of the inventive concepts.

BRIEF DESCRIPTION OF THE DRAWINGS

The above and other objects, features and advantages of the present inventive concepts will be more apparent from the following detailed description taken in conjunction with the accompanying drawings, in which.

DETAILED DESCRIPTION

Figure 1:
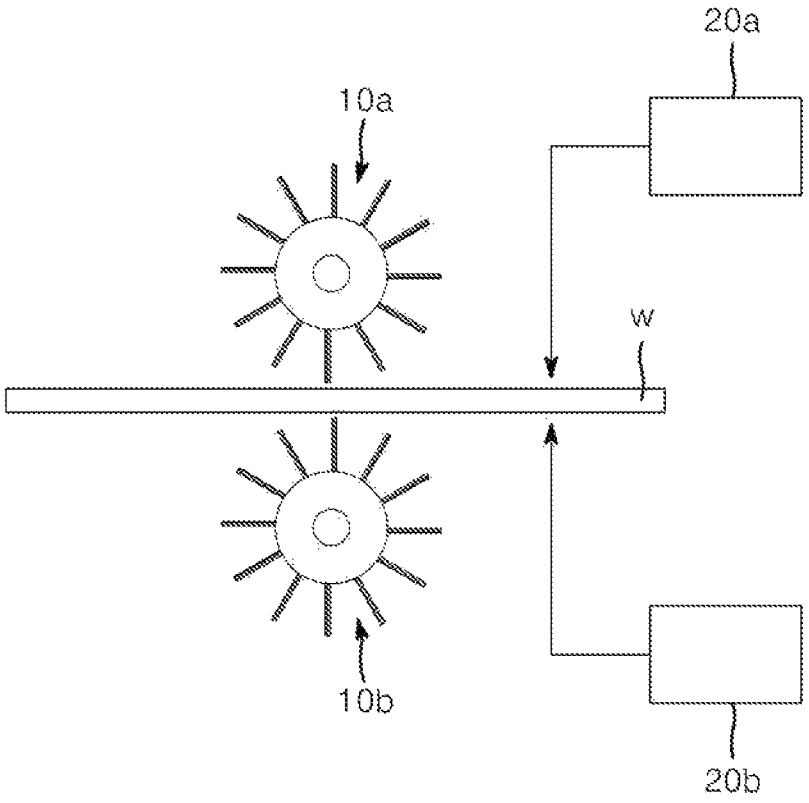
FIG. 1 is a schematic view illustrating a cleaning system after polishing an organic film using a cleaning composition according to example embodiments of the present inventive concepts.

Example embodiments of the present inventive concepts will be described more fully hereinafter with reference to the accompanying drawings. In the drawings, the size and relative sizes of layers and regions may be exaggerated for clarity. Like reference numerals may refer to like elements throughout the accompanying drawings.

It will be understood that when an element or layer is referred to as being "on," "connected to", or "covered by" another element or layer, it can be directly on, connected to, or covered by the other element or layer or intervening elements or layers may be present. In addition, it will also be understood that when an element or layer is referred to as being "between" two elements or layers, it can be the only element or layer between the two elements or layers, or one or more intervening elements or layers may also be present. As used herein, the term "and/or" includes any and all combinations of one or more of the associated listed items. Further, when two or more elements or values are described as being substantially the same as or equal to each other, it is to be understood that the elements or values are identical to each other, indistinguishable from each other, or distinguishable from each other but functionally the same as each other as would be understood by a person having ordinary skill in the art.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be understood that, although the terms first, second, etc. may be used herein to describe various elements, these elements should not be limited by these terms. These terms are only used to distinguish one element from another element. Thus, for example, a first element, a first component or a first section discussed below could be termed a second element, a second component or a second section without departing from the teachings of the present inventive concepts.

The present inventive concepts will be described with reference to perspective views, cross-sectional views, and/or plan views, in which example embodiments of the inventive concepts are shown. Thus, the profile of an example view may be modified according to manufacturing techniques and/or allowances. That is, example embodiments of the inventive concepts are not intended to limit the scope of the present inventive concepts but cover all changes and modifications that can be caused due to a change in manufacturing process. Thus, regions shown in the drawings are illustrated in schematic form and the shapes of the regions are presented simply by way of illustration and not as a limitation.

The terminology used herein is for the purpose of describing particular example embodiments only and is not intended to be limiting of example embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Example embodiments may be described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will typically have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature, their shapes are not intended to illustrate the actual shape of a region of a device, and their shapes are not intended to limit the scope of the example embodiments.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Cleaning Composition after Polishing an Organic Film

In example embodiments of the present inventive concepts, the term "polishing an organic film" means planarization of the surface of the organic film through chemical mechanical polishing (CMP).

In example embodiments of the present inventive concepts, the term "pollutants" means foreign substances, for example, organic film dregs, on the surface of an organic film, which are generated in a polishing process, or residual substances, for example, polished particles of a CMP slurry composition. However, example embodiments of the present inventive concepts are not limited thereto.

A cleaning target object to which a cleaning composition according to example embodiments of the present inventive concepts is applied is an "organic film".

In example embodiments, the organic film may include a carbon content of 50 to 95 atom %, for example, 65 to 95 atom %, or 70 to 92 atom %.

By performing polishing with metal oxide abrasives in the above-described range, the polishing rate becomes relatively high, and the flatness of the polished surface becomes desirable. Further, in the case of cleaning the organic film, the pollutant removing effect of the surface of the organic film becomes relatively high, and sufficient scratch resistance thereof can be secured.

In example embodiments, the organic film may have film density of 0.5 to 2.5 g/cm$^3$, for example, 1.0 to 2.0 g/cm$^3$ or 1.2 to 1.6 g/cm$^3$. By performing polishing with metal oxide abrasives in the above-described range, the polishing rate becomes relatively high, and the flatness of the polished surface becomes desirable. Further, in the case of cleaning the organic film, the pollutant removing effect of the surface of the organic film and the scratch resistance thereof become desirable, and the remaining pollutants can be effectively prevented or inhibited from being re-adsorbed onto the brush.

In example embodiments, the organic film may have hardness of equal to or higher than 0.4 GPa, for example, equal to or higher than 1.0 GPa or equal to or higher than 1.3 GPa, and for example, in the range of 1.0 to 1.5 GPa. By performing polishing with metal oxide abrasives in the above-described range, the polishing rate becomes relatively high, and the flatness of the polished surface becomes desirable. Further, in the case of cleaning the organic film, the pollutant removing effect of the surface of the organic film and the scratch resistance thereof becomes desirable, and the remaining pollutants can be effectively prevented or inhibited from being re-adsorbed onto the brush.

The cleaning composition after polishing the organic film according to example embodiments of the present inventive concepts includes an organic solvent A, an organic acid B, a chelating agent C, and a surfactant D. The cleaning composition is a basic cleaning composition with a pH of equal to or higher than 12.

The organic solvent A may be a compound having miscibility with water, and may include one or more organic solvents selected from the group including tetramethyl ammonium hydroxide (TMAH), dimethylacetamide (DMAC), N-methylpyrrolidone (NMP), dimethyl sulfoxide (DMSO), 1,4-dioxane, propylene glycol monomethyl ether (PGME), dimethylformamide, N-methylformamide, formamide, dimethyl-2-piperidone (DMPD), tetrahydrofurfuryl alcohol, glycerol, and ethylene glycol.

The organic solvent may be 0.01 to 10.00 wt % of the total weight of the cleaning composition. Within the above-described range, the organic film is more easily dissolved, and repulsion between the organic film and polished particles or polished organic materials is increased to heighten the cleaning efficiency.

The organic acid B has a function and effect of improving dispersion of the polished organic materials in the cleaning composition according to example embodiments of the present inventive concepts.

As the organic acid, an organic acid compound having one or more carboxyl groups may be used. Specifically, the organic acid may include one or more compound selected from the group including acetic acid, citric acid, glutaric acid, glycolic acid, formic acid, lactic acid, malic acid, maleic acid, oxalic acid, phthalic acid, succinic acid, and tartaric acid.

The organic acid may be 0.01 to 3.00 wt % of the total weight of the cleaning composition. Within the above-described range, the polished organic materials have improved dispersion.

The chelating agent C serves to remove the polished particles that are caused by the CMP slurry in the cleaning composition according to example embodiments of the present inventive concepts. The chelating agent may be an ammonium-based compound, an amine-based compound, or their salts. For example, the chelating agent may be ammonium acetate, ammonium oxalate, ammonium formate, ammonium tartrate, ammonium lactate, ammonium tetrahydrate, aminobenzotriazole, aminobutyric acid, aminoethylaminoethanol, aminopyridine, and their salts.

The chelating agent may be 0.01 to 1.00 wt % of the total weight of the cleaning composition. Within the above-described range, the particles that are caused by the CMP slurry can be more easily removed.

The surfactant D is a compound that contains at least one hydroxyl group (OH) at the end.

In example embodiments, the number of hydroxyl groups (OH) that the surfactant contains may be 1 to 20. Within the above-described range, the cleaning effect of the organic film becomes desirable, and the pollutants can be prevented or inhibited from being re-adsorbed onto the brush and the organic film.

In example embodiments, the surfactant may be an aromatic compound that contains at least one hydroxyl group (OH) at the end. Specifically, the surfactant may include 20 or less aromatic rings. In the case where the surfactant includes the aromatic rings as described above, a more desirable cleaning effect can be obtained through a bulky chemical structure.

The cleaning composition according to example embodiments of the present inventive concepts is a basic cleaning composition with a pH of equal to or higher than 12. The pH of the cleaning composition may be specifically 12 to 13, and more specifically, 12.1 to 12.5. Within the above-described range, the pollutants are made to have the same electric potential as that of the organic film material, and thus a repulsion force is generated between the surfaces through zeta potential. Accordingly, the cleaning effect of the organic film can be further improved.

In order to adjust the pH value, the cleaning composition according to example embodiments of the present inventive concepts may further include a pH adjuster. The pH adjuster is included to adjust the pH of the cleaning composition to a desirable amount.

The cleaning composition after polishing the organic film according to example embodiments of the present inventive concepts has a desirable cleaning effect after polishing the organic film, and can minimize or reduce the generation of scratches on the surface of the organic film.

Further, in the case of the brush onto which the pollutants are re-adsorbed, the pollutants may collect on any one side or at the edges of the surface of the organic film. That is, the position deviation that the pollutants remain on the wafer becomes relatively high, and this may deteriorate the cleaning effect. In contrast, the cleaning composition according to example embodiments of the present inventive concepts can prevent or inhibit the pollutants from being re-adsorbed onto the brush. Accordingly, the position deviation of the pollutants that remain on the surface of the organic film can be minimized or reduced, and thus desirable cleaning efficiency can be achieved.

Cleaning Method after Polishing of Organic Film

A cleaning method after polishing an organic film according to example embodiments of the present inventive concepts may be performed using the above-described cleaning composition.

In example embodiments, the cleaning method after polishing an organic film may clean the surface of the organic film using a cleaning system that includes a cleaning composition supply portion supplying the cleaning composition and a cleaning portion provided with a brush.

FIG. 1 is a schematic view illustrating a cleaning system after polishing an organic film using a cleaning composition according to example embodiments of the present inventive concepts. Referring to FIG. 1, the cleaning system may include a cleaning composition supply portion supplying a cleaning composition onto the surface of a provided wafer, and a cleaning portion cleaning the surface of the wafer to which the cleaning composition is supplied.

On the surface of the wafer W that is supplied to the cleaning system, the organic film is formed. The cleaning portion may be provided with a first roll-brush 10*a* cleaning an upper surface of the wafer W, and a second roll-brush 10*b* cleaning a lower surface of the wafer W. The supply direction of the wafer W that is supplied to the cleaning system may be perpendicular to the length direction of the roll-brushes 10*a* and 10*b*, and may be in parallel to the rotating direction of the roll-brushes 10*a* and 10*b*. Before the wafer W is transported to the cleaning portion, the cleaning composition that is supplied from cleaning composition supply portions 20*a* and 20*b* may be spread on the surface of the wafer W. However, example embodiments of the present inventive concepts are not limited thereto. The cleaning composition may be supplied simultaneously with the cleaning by the roll-brushes 10*a* and 10*b*.

The cleaning system of FIG. 1 exemplifies only a single cleaning portion that is composed of a pair of roll-brushes 10*a* and 10*b*. However, example embodiments of the present inventive concepts are not limited thereto. The cleaning system may include a plurality of cleaning portions that are connected in series in multistage.

Hereinafter, example embodiments of the present inventive concepts will be described in detail with reference to example embodiments thereof. However, such embodiments are merely for explanation, and thus example embodiments of the present inventive concepts are not limited to such embodiments. Further, through the example embodiments described hereinafter, a CMP method is provided to planarize a phase change material.

EXAMPLES

Example 1

Figure 2:
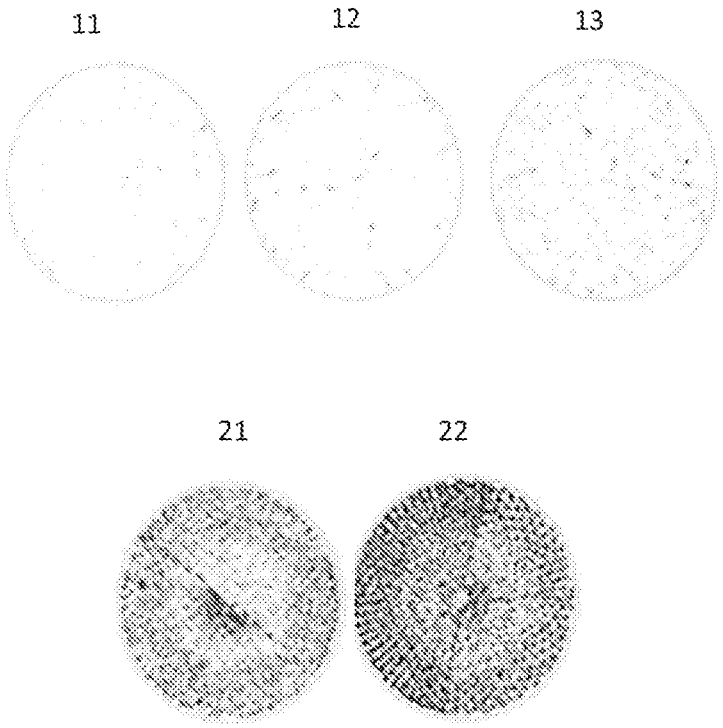
FIG. 2 is a view illustrating wafermaps including a wafer surface after cleaning according to example embodiments, and according to comparative examples.

A cleaning composition was manufactured with a composition of Table 1 below. An acetic acid (SAMCHUN Chemical Corporation, EP grade) was used as the organic acid, and TMAH (HANTOK Chemical Corporation, semiconductor grade 20% aqueous solution) was used as the organic solvent. Further, ammonium acetate (Sigma-Aldrich Corporation, ACS reagent) was used as the chelating agent, and a compound that is expressed by Chemical Formula 1 was used as the surfactant. Wafermap 11 of FIG. 2 illustrates a wafer surface after cleaning.

[Chemical Formula 1]

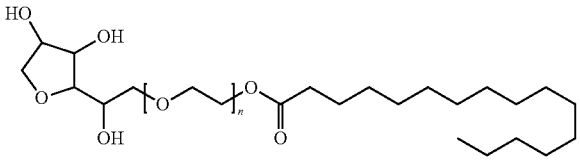

Example 2

A compound that is expressed by Chemical Formula 2 below was used as the surfactant, and a cleaning composition was manufactured in the same method as that according to Example 1 except for the composition of Table 1. Wafermap 13 of FIG. 2 illustrates a wafer surface after cleaning.

[Chemical Formula 2]

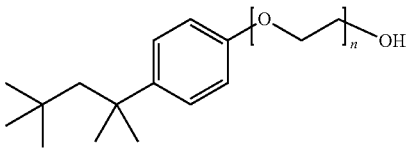

Example 3

A compound that is expressed by Chemical Formula 3 below was used as the surfactant, and a cleaning composition was manufactured in the same method as that according to Example 1 except for the composition of Table 1. Wafermap 13 of FIG. 2 illustrates a wafer surface after cleaning.

[Chemical Formula 3]

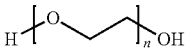

Comparative Example 1

Surfactant was not used, and a cleaning composition was manufactured in the same method as that according to Example 1 except for the composition of Table 1. In Comparative Example 1, the cleaning was performed using a brush that was not polluted. Wafermap 21 of FIG. 2 illustrates a wafer surface after cleaning.

Comparative Example 2

Surfactant was not used, and a cleaning composition was manufactured in the same method as that according to Example 1 except for the composition of Table 1. In Comparative Example 2, the cleaning was performed using a brush that was polluted after the cleaning of the organic film for 30 seconds with distilled water was performed 10 times. Wafermap 22 of FIG. 2 illustrates a wafer surface after cleaning.

Organic Film, Polishing Condition, Cleaning Condition, and Physical Property Evaluation Method Organic film: As an organic film to be cleaned, a material of Example 1 (disclosed in Korean Registered Patent No. 1257697) was used.

Polishing condition: As a polishing pad, H0800 CMP pad of FUJIBO Corporation was used. As the CMP slurry, an acid abrasive solution including colloidal silica as an abrasive material, an organic acid, an oxidant, and a complexing agent was used. Polishing was performed for 1 minute with falling pressure of 1.0 psi, slurry flow speed of 200 ml/min, and table and spindle speed of 90 rpm using 200 mm MIRRA equipment of Applied Materials Corporation (AMAT).

Cleaning condition: The cleaning composition of embodiments and comparative examples was put with a flow rate of 1500 ml/min, and the surface of an organic film was cleaned for 60 seconds at a brush speed of 400 rpm and wafer rotating speed of 50 rpm.

pH value measurement: The pH value of the cleaning composition was measured using a pH meter of Metrohm Corporation.

Total number of defects: The total number of pollutants of a wafer having a radius of 150 mm was measured using LS6800 of Hitachi Corporation.

TABLE 1

| | Examples | | | Comparative Examples | |
|---|---|---|---|---|---|
| Division | 1 | 2 | 3 | 1 | 2 |
| (A) Organic solvent | 1 | 1 | 1 | 1 | 1 |
| (B) Organic acid | 0.02 | 0.02 | 0.02 | 0.02 | 0.02 |
| (C) Chelating agent | 0.01 | 0.01 | 0.01 | 0.01 | 0.01 |
| (D) Surfactant | 0.01 | 0.008 | 0.02 | — | — |
| Ultra pure water | 98.96 | 98.962 | 98.95 | 98.97 | 98.97 |
| pH value of cleaning composition | 12.12 | 12.18 | 12.15 | 12.22 | 12.22 |
| Total number of defects | 189 | 453 | 756 | 14997 | 29924 |

(Unit: wt %)

In Example 1, the surfactant that is expressed by Chemical Formula 1 has a relatively large number of hydroxyl groups (OH) and branches in a molecule, and thus can efficiently protect the brush. Accordingly, it is possible to prevent or inhibit pollution of the brush and re-adsorption of pollutants onto the organic film, and thus it can be known that the number of pollutants that remain on the surface of the organic film and the position deviation can be reduced. Further, even in Example 2 and Example 3 3, the number of pollutants on the surface of the organic film after cleaning can be reduced, and the position deviation of the pollutants is lowered.

In contrast, according to Comparative Example 1 in which the cleaning composition that does not include the surfactant is cleaned by a brush that is not polluted and Comparative Example 2 in which the cleaning composition is cleaned by a polluted brush, it can be confirmed by eye that the pollutants that remain after the polishing of the organic film are not cleaned even after the cleaning, which causes pollution. In particular, according to Comparative Example 2, a module pattern of the brush remains clearly on the surface of the wafer causing more pollution.

While the present inventive concepts have been particularly shown and described with reference to the example embodiments thereof, it will be understood by those of ordinary skill in the art that various changes in form and detail may be made therein without departing from the spirit and scope of the present inventive concepts as defined by the following claims.

What is claimed is:

1. A composition for cleaning an organic film, the composition comprising:

an organic solvent, an organic acid, a chelating agent, a surfactant containing at least one hydroxyl group (OH) at an end, and an ultra pure water, wherein a pH value of the composition is greater than or equal to 12, wherein the composition includes 0.01 to 10.00 wt % of the organic solvent, 0.01 to 3.00 wt % of the organic acid, 0.01 to 1.00 wt % of the chelating agent, 0.0001 to 0.2 wt % of the surfactant, and 85.8 to 99.9 wt % of the ultra pure water based on a total weight of the composition.

2. The composition of claim 1, wherein the pH value is 12 to 13.

3. The composition of claim 1, wherein the surfactant contains 1 to 20 hydroxyl groups at the end.

4. The composition of claim 3, wherein the surfactant is an aromatic compound including 20 or less aromatic rings.

5. The composition of claim 1, wherein the organic solvent includes at least one of tetramethyl ammonium hydroxide (TMAH), dimethylacetamide (DMAC), N-methylpyrrolidone (NMP), dimethyl sulfoxide (DMSO), 1,4-dioxane, propylene glycol monomethyl ether (PGME), dimethylformamide, N-methylformamide, formamide, dimethyl-2-piperidone (DMPD), tetrahydrofurfuryl alcohol, glycerol, and ethylene glycol.

6. The composition of claim 1, wherein the organic acid includes at least one of acetic acid, citric acid, glutaric acid, glycolic acid, formic acid, lactic acid, malic acid, maleic acid, oxalic acid, phthalic acid, succinic acid, and tartaric acid.

7. The composition of claim 1, wherein the chelating agent includes at least one of ammonium acetate, ammonium oxalate, ammonium formate, ammonium tartrate, ammonium lactate, aminobenzotriazole, aminobutyric acid, aminoethylaminoethanol, aminopyridine, and their salts.

8. A method of cleaning a surface of the organic film after polishing the organic film using the composition according to claim 1.

9. A cleaning composition comprising an aromatic surfactant containing at least one hydroxyl group (OH) at an end, the surfactant including 20 or less aromatic rings, wherein a pH value of the cleaning composition is greater than or equal to 12, and wherein the cleaning composition includes 0.01 to 10.00 wt % of an organic solvent, 0.01 to 3.00 wt % of an organic acid, 0.01 to 1.00 wt % of a chelating agent 0.001 to 0.2 wt % of the surfactant, and 85.8 to 99.9 wt % of an ultra pure water based on a total weight of the cleaning composition.

10. The cleaning composition of claim 9, wherein the surfactant contains 1 to 20 hydroxyl groups at the end.

11. The cleaning composition of claim 9, further comprising:

the organic solvent including at least one of tetramethyl ammonium hydroxide (TMAH), dimethylacetamide (DMAC), N-methylpyrrolidone (NMP), dimethyl sulfoxide (DMSO), 1,4-dioxane, propylene glycol monomethyl ether (PGME), dimethylformamide, N-methylformamide, formamide, dimethyl-2-piperidone (DMPD), tetrahydrofurfuryl alcohol, glycerol, and ethylene glycol;

the organic acid including at least one of acetic acid, citric acid, glutaric acid, glycolic acid, formic acid, lactic acid, malic acid, maleic acid, oxalic acid, phthalic acid, succinic acid, and tartaric acid; and the chelating agent including at least one of ammonium acetate, ammonium oxalate, ammonium formate, ammonium tartrate, ammonium lactate aminobenzotriazole, aminobutyric acid, aminoethylaminoethanol, aminopyridine, and their salts.

12. A cleaning system comprising:

a composition supply portion configured to supply the composition of claim 1 on exposed surfaces of an organic film; and at least one cleaning portion configured to clean the surfaces of the organic film having the composition supplied thereon, wherein the at least one cleaning portion includes first and second roll-brushes configured to clean the surfaces of the organic film having the composition supplied thereon, and wherein the composition supply portion includes first and second portions configured to supply the composition to the exposed surfaces of the organic film.

13. The cleaning system of claim 12, wherein the surfactant contains 1 to 20 hydroxyl groups at the end, and the surfactant is an aromatic compound including 20 or less aromatic rings.

14. The cleaning system of claim 12, wherein the organic film has a carbon content of 50 to 95 atom %, a film density of 0.5 to 2.5 g/cm$^3$, and a hardness of greater than or equal to 0.4 GPa.

* * * * *